US005481860A

United States Patent [19]

Stahlecker et al.

[11] Patent Number: 5,481,860

[45] Date of Patent: Jan. 9, 1996

[54] SPINNING MACHINE HAVING A PLURALITY OF SPINNING STATIONS WITH INDEPENDENTLY CONTROLLABLE DELIVERY ROLLERS

[76] Inventors: Fritz Stahlecker, Josef-Neidhart-Strasse 18, 7347 Bad Überkingen; Hans Stahlecker, Haldenstrasse 20, 7334 Süssen, both of Germany

[21] Appl. No.: 221,576

[22] Filed: Apr. 1, 1994

Related U.S. Application Data

[63] Continuation-in-part of Ser. No. 914,414, Jul. 17, 1992, abandoned.

[30] Foreign Application Priority Data

Jul. 23, 1991 [DE] Germany ..... 41 24 312.9

[51] Int. Cl.[6] ..... D01H 13/04

[52] U.S. Cl. ..... 57/90; 57/81; 57/87

[58] Field of Search ..... 57/90, 315, 78, 57/80, 81, 83, 86, 87

[56] References Cited

U.S. PATENT DOCUMENTS 1,462,896 7/1923 Barksdale et al. .
2,623,348 12/1952 Bade .
2,807,131 9/1957 Bade .
3,312,050 4/1967 Noguera .
4,450,677 5/1984 von Ronai-Horvath et al. .
4,501,114 2/1985 von Ronai-Horvath et al. .

FOREIGN PATENT DOCUMENTS 1015780 1/1966 United Kingdom .

*Primary Examiner*—Joseph J. Hail, III
*Attorney, Agent, or Firm*—Evenson McKeown Edwards & Lenahan

[57] ABSTRACT

In the case of a spinning machine comprising several spinning stations, which each contain one drafting unit, and comprising depositing sites for cans containing sliver, transport devices are provided for the transporting of the delivers from the cans to the spinning stations. The transport devices comprise delivery rollers which can be stopped independently of the delivery rollers of other spinning stations and independently of the pertaining drafting unit.

19 Claims, 3 Drawing Sheets

22
20
19
18
16
12
B
11
13
A
5
23
10
15
21
C
6
17
24
14
7
25
IV
28
4
26
27
2
3
9
D
1
8

SPINNING MACHINE HAVING A PLURALITY OF SPINNING STATIONS WITH INDEPENDENTLY CONTROLLABLE DELIVERY ROLLERS

This application is a Continuation-in-Part of application Ser. No. 07/914,414 filed on Jul. 17, 1992, now abandoned.

BACKGROUND AND SUMMARY OF THE INVENTION

This invention relates to a spinning machine comprising several spinning stations, which each contain a drafting unit, comprising depositing sites for cans containing sliver, and comprising transport devices containing delivery rollers for the transport of the slivers from the cans to the spinning stations.

In the case of a spinning machine of this type (British Patent Document GB-PS 10 15 780), which is constructed as a ring spinning machine, the transport device has two transport belts for each spinning station. These transport belts form a pair of transport belts which receive and transport a sliver between one another. Directly in front of the drafting unit, the transport belt winds around a drivable delivery roller. The delivery roller can tap its drive by way of a frictional wheel selectively from the lower feeding cylinder of the pertaining drafting unit or—for an accelerated first time feeding of a sliver—from a driving roller which can be driven much faster. A stopping of the delivery rollers is not intended.

In an older German Patent Application P 41 11 000.5, which is no prior publication, it was suggested, for the first-time feeding of the slivers, to jointly stop the delivery rollers of all spinning stations, independently of the drafting units.

It is an object of the invention to be able to stop the sliver supply of a single spinning station in the case of a spinning machine of that above-mentioned type.

This object is achieved according to preferred embodiments of the invention in that the delivery rollers of a drafting unit at a single spinning station can be stopped independently of the delivery rollers of other spinning stations and independently of the pertaining drafting unit.

As a result, it is possible to interrupt the supply of sliver to the disrupted spinning station without having to intervene in the drafting unit in the case of a yarn breakage. This is advantageous in that the known sliver stopping devices on drafting units present serious problems and usually have the result that, after a stopping of the drafting units, the spinning cannot easily be continued.

Advantageously, the delivery rollers of several spinning stations are connected to a central drive from which they can be drivingly connected and disconnected separately. This is achieved according to certain preferred embodiments by arranging the delivery rollers on a drivable shaft which extends in the longitudinal direction of the machine and connecting them with this shaft by way of a coupling. In the case of such a development, the spinning operation can easily be continued after an interruption of the sliver supply.

In an advantageous development of the invention, it is provided that the delivery rollers are each assigned to a transport belt transporting at least one sliver. In the case of such a solution, the whole distance between the sliver supply can and the pertaining spinning station can be bridged by means of a single delivery roller because it is the transport belt that guides the slivers. Therefore, the transport as a whole is also interrupted and can be continued at any time without the occurrence of faulty drafts anywhere in the sliver. As a result, it is possible to securely transport also very fine slivers, that is, slivers of sizes from Nm 0.3 to 0.8 without the risk of drafts during the operational transport. In the case of ring spinning machines, the machine that is normally connected in front of the ring spinning machine, specifically the flyer, will then not be necessary. Since the otherwise customary flyer twist is absent, the slivers can be drawn more in the drafting units so that ordinary three-cylinder drafting units can be used.

Advantageously, the delivery rollers are connected directly in front of the pertaining drafting unit. The transport of the slivers will then be more easily controllable, and it is expedient to let the delivery rollers run slightly more slowly than the feeding roller of the drafting units arranged behind them so that a slight tensioning draft is created which, however, does not result in a faulty draft.

In a further development of the invention, it is provided that the delivery rollers can be stopped from several operating sites. This is particularly recommendable when the cans are not deposited not on the floor, but rather above the spinning machine in an elevated manner on a platform or even on another floor.

A preferably optical sensor is expediently assigned to the delivery rollers for determining the presence of sliver. This is particularly useful when sliver is transported for the first time, for example, after a batch change. Since the transport of the sliver is very slow upstream of the drafting unit, it takes several minutes until a new sliver has passed through the transport path to the pertaining spinning station. It cannot be assumed that an operator is present at the spinning station exactly when the sliver arrives there. For this reason, it is useful to interrupt the transport of the sliver as soon as the sensor reports the presence of a new sliver at a spinning station. The transport can then be switched on again manually after the sliver is introduced into the drafting unit.

The delivery rollers are expediently connected with the shaft that drives them by way of a torque limiter. As a result, it becomes possible to simply stop the delivery roller while the shaft driving it continues to rotate.

A cam, which rotates along with the delivery rollers and to which a stop can be applied for the stopping of the delivery roller, is advantageously assigned to the delivery rollers. As a result, it becomes possible in a simple manner to stop the delivery roller while the drive shaft continues to rotate.

Other objects, advantages and novel features of the present invention will become apparent from the following detailed description of the invention when considered in conjunction with the accompanying drawings.

DETAILED DESCRIPTION OF THE DRAWINGS

Figure 1:
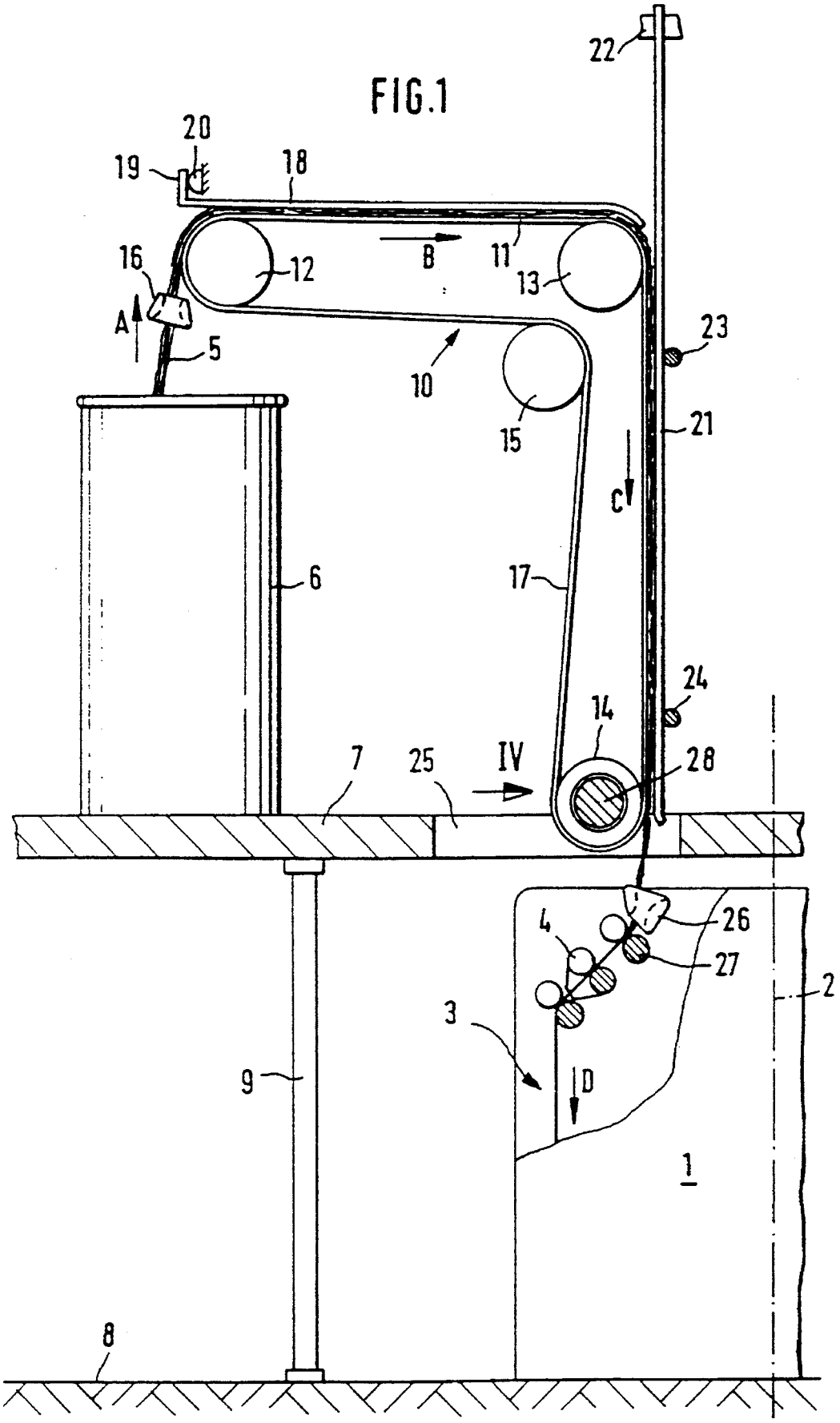
FIG. 1 is a partial part cross-sectional schematic view of a spinning machine system with a spinning machine to which the fiber material is fed in the form of a sliver in a can which is deposited in an elevated manner and from which the sliver is transported to the spinning stations by means of a transport device, constructed according to a preferred embodiment of the invention.

The spinning machine 1 illustrated in FIG. 1, which may be a ring spinning machine, on both sides of the longitudinal center plane 2, is provided on each side of the machine with a plurality of spinning stations 3 which are arranged next to one another in a known manner. In FIG. 1, only one spinning station 3 is visible, of which only one drafting unit 4 is illustrated.

The fiber material is fed to the spinning stations 3 in the form of sliver 5. This sliver is preferably in the size range of from Nm 0.3 to 0.8. The fed sliver 5 is deposited in cans 6 which are deposited opposite the spinning machine 1 in an elevated manner on a platform 7. The platform 7 extending above the spinning machine 1 is supported on the floor 8 by means of supports 9.

Since the diameter of the cans 6 is larger than the spacing between two adjacent spinning stations 3, the cans 6 are deposited in several rows in the longitudinal direction of the machine in a manner that is not shown.

The sliver 5 is transported from the cans 6 to the spinning stations 3 by means of a transport device 10. The transport device 10 comprises a transport belt 11 which is guided by way of a total of four deflecting rollers 12, 13, 14 and 15. In the present case, the delivery roller is the deflecting roller 14.

The deflecting roller 12 is disposed closely above the pertaining can 6. By way of a sliver guide 16, the sliver 5 is first withdrawn from the can 6 in the direction of the arrow A and is then transported approximately horizontally in the direction of the arrow B to the deflecting roller 13. Between the deflecting roller 13 and the delivery roller 14, the transport belt 11 runs essentially perpendicularly vertically downward corresponding to the direction of the arrow C. From the delivery roller 14, the returning run 17 travels over a deflecting roller 15 situated in the proximity of deflecting roller 13. On the whole, an angular, particularly right angle course of the transport device 10 is obtained.

Along the horizontal transport path indicated by the direction of the arrow B, the sliver 5 is pressed against the transport belt 11 by means of a skid 18. On its underside facing the sliver 5, the skid 18 is very smooth and is supported by means of a projection 19 against a stop 20 so that the skid 18 is fixed in the longitudinal direction. In the lateral direction, the skid 18 may be secured with respect to the transport belt 11 by lateral guides which are not shown.

In the vertical direction, which is characterized by the arrow C, the sliver 5 is pressed against the transport belt 11 by a skid 21. The skid 21 is suspended above the deflecting roller 13 in a suspension 22 and is pressed against the transport belt 11 with a slight contact pressure by means of adjustable rods 23 and 24 that extend in the longitudinal direction of the machine. Through a recess 25 of the platform 7, the sliver travels to a feeding hopper 26 of the pertaining spinning station 3. The drafted sliver will then travel in the direction of the arrow D toward a twist providing element, such as a ring spindle, which is not shown.

So that, when the sliver 5 leaves the delivery roller 14, it receives a slight tensioning draft which however, must not result in a drafting of the sliver 5, the pair of feeding rollers 27 of the drafting unit 4 rotates slightly, for example, between 0.5% and 3% faster than the delivery roller 14. A preferred pre-determinable speed difference is 1.5%. This speed difference can be set to be a fixed speed difference.

The delivery roller 14 is arranged on a drivable shaft 28 which extends through in the longitudinal direction of the machine and to which it can be coupled during the spinning operation and from which it can be uncoupled for interrupting the spinning operation. In the manner described in the following, the arrangement is such that each delivery roller 14 can be stopped independently of adjacent delivery rollers and independently of the drafting unit 4. The coupling mechanism, which is constructed as a torque limiter, will now be described by means of FIGS. 2 and 3:

As illustrated, the delivery roller 14 is constructed as a sleeve which is bordered on its two end faces 29 and 30 by slide bushes 31 and 32 which slide by means of sliding surfaces 33 on the outer circumference of the drivable shaft 28. The slide bushes 31 and 32 are made of plastic which has only a slight coefficient of friction with respect to the drivable shaft 28. The slide bushes 31 and 32 have an angular cross-section so that axial sections 34 and 35 exist which support the delivery roller 14 along a portion of its axial length. A ring chamber 36 exists between the delivery roller 14 and the shaft 28 which accommodates a coupling device. In the area between the slide bushes 31 and 32, the interior surface of the delivery roller 14 is provided with a detent tooting 37 into which a detent spring 38 engages which establishes the coupling connection between the shaft 28 and the delivery roller 14.

The detent spring 38 is a leaf spring which is fastened by means of one or several countersunk screws 39 to the outer circumference of the driving shaft 28. The detent spring 38 extends along approximately the whole axial length of the ring chamber 36. By means of a leg, the detent spring 38 projects approximately tangentially away from the shaft 28 and, by means of its end 40, which is bent approximately perpendicularly to the interior toward the shaft 28, engages in the detent tooting 37.

The detents of the detent tooting 37 are bounded by flanks 41 in the driving direction E of the shaft 28 and thus in the normal moving direction F of the delivery roller 14, these flanks 41 extending in parallel to the detent spring 38, that is, also at least approximately tangentially with respect to the shaft 28. Against the driving direction E, the detents of the detent tooting 37 are bounded by flanks 42 which extend approximately perpendicularly to the detent spring 38, that is, approximately perpendicularly to a tangent on the circumference of the shaft 28. As illustrated particularly in FIG. 2, the end 40 of the detent spring 38 is bordered by a round transition, this rounding corresponding to the transition between the two flanks 41 and 42 of the detent tooting 37.

During the normal operation, the detent spring 38 engages with its end 40 in one of the detents of the detent tooting 37 so that a form-locking coupling connection exists between the driving shaft 28 and the delivery roller 14. Thus, it is ensured that the delivery roller 14 is driven at the same rotational speed as the shaft 28. The coupling device is therefore able to establish a form locking connection between the shaft 28 and the delivery roller 14 which is eliminated only when a certain torque is exceeded.

The amount of the transferable torque depends essentially on the development of the detent spring 38, that is, on its strength and spring rigidity. When this torque is exceeded, which happens when the delivery roller 14 is stopped, the detent spring 38 is automatically lifted out of the detent tooting 37 so that the shaft 28 can continue to rotate while, however, the delivery roller 14 is stopped. Therefore, the coupling device acts as a free wheel against the driving direction which permits a stopping of the delivery roller 14 with respect to the driving shaft 28.

Figure 2:
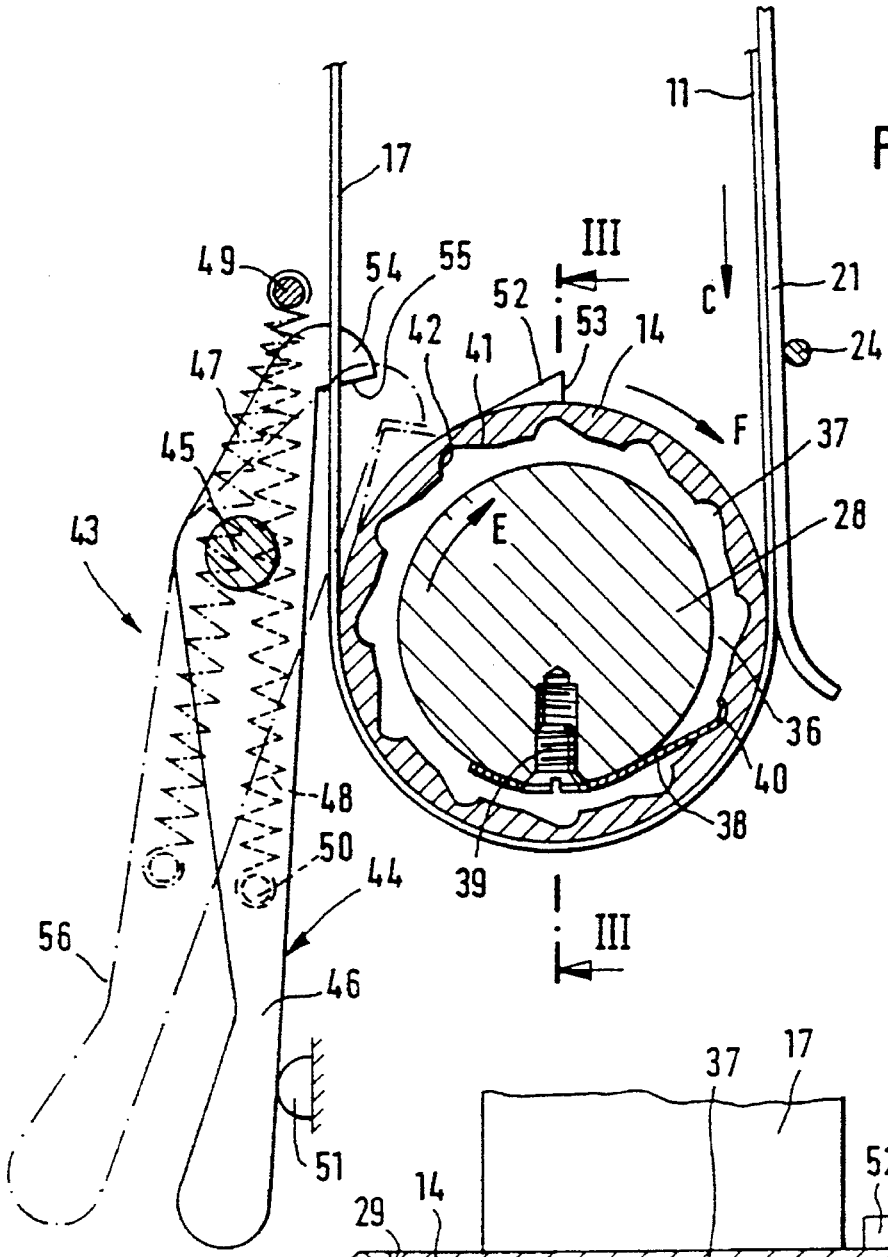
FIG. 2 is a very enlarged partial sectional view of FIG. 1 in the area of the delivery roller of the transport device.
Figure 3:
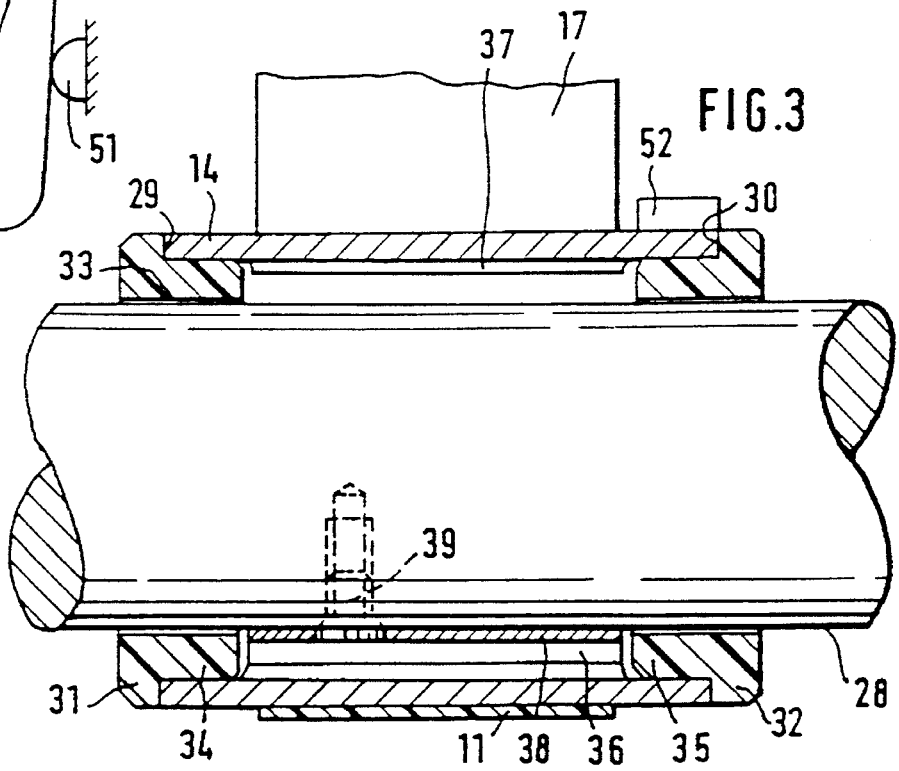
FIG. 3 is a view along sectional plane III—III of FIG. 2.

A manual actuating mechanism 43 is used for the actuating of the coupling device according to FIGS. 2 and 3. This actuating mechanism 43 comprises a two-armed lever 44 which is pivotally arranged on a stationary shaft 45. The lever 44 has two lever arms 46 and 47. In the normal spinning operation, the operating position of the lever 44 is secured by means of a tension spring 48 which is constructed as a dead-center spring. It is suspended above the shaft 45 at a pin 49 and is fastened below the shaft 45 to a hinge pin 50 of the lever 44. The tension spring 48 therefore pulls the arm 46 of the lever 44 against a stop 51.

Outside the area of the transport belt 11, the delivery roller 14 is provided with a tooth-type cam 52 which rotates along with the delivery roller 14. It has a surface 53 which extends approximately radially with respect to the delivery roller 14. As necessary, this surface 53 is used for the stopping of the delivery roller 14, that is, its uncoupling from the driving shaft 28.

The arm 47 of the lever 44 has a projection 54 which is also provided with a surface 55 which can be engaged with the surface 53 of the cam 52. For this purpose, the lever 44 can be swivelled by means of a manual swivelling about its shaft 45 into the position 56 which is indicated by a dash-dotted line in which it will then be held by the tension spring 48 constructed as a dead center spring. In this case, the surface 44 of the projection 54 is placed against the surface 53 of the cam 52 as soon as this cam 52 has reached the corresponding position during the rotation with the delivery roller 14. As a result, the delivery roller 14 is stopped, in which case the transferable torque of the detent spring 38 is exceeded and the delivery roller 14 is therefore uncoupled from the shaft 28.

Figure 4:
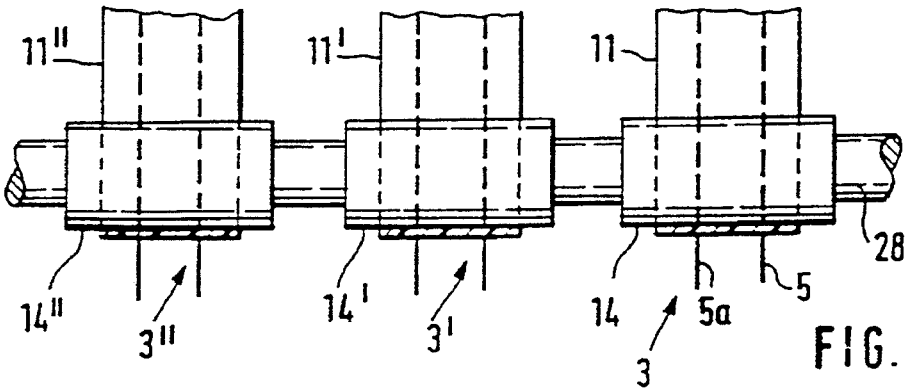
FIG. 4 is a partial view in the direction of the arrow IV of FIG. 1.

FIG. 4 again illustrates the driving shaft 28 which extends along several spinning stations 3, 3', 3" as well as the three delivery rollers 14, 14', and 14" which are arranged next to one another. A transport belt 11, 11', and 11" is assigned to each delivery roller 14, 14', and 14". Each transport belt 11, 11', and 11" transports two slivers 5 and **5*a* which are arranged next to one another. The transporting of two slivers 5 and 5*a* by means of one transport belt 11, 11', or 11" is useful because the pressure rollers of the drafting units 4** are normally constructed as pressure roller pairs anyhow.

As required, the delivery roller 14 can be stopped in the above-described manner independently of the other delivery rollers 14' and 14" and independently of the pertaining drafting unit 4.

Figure 5:
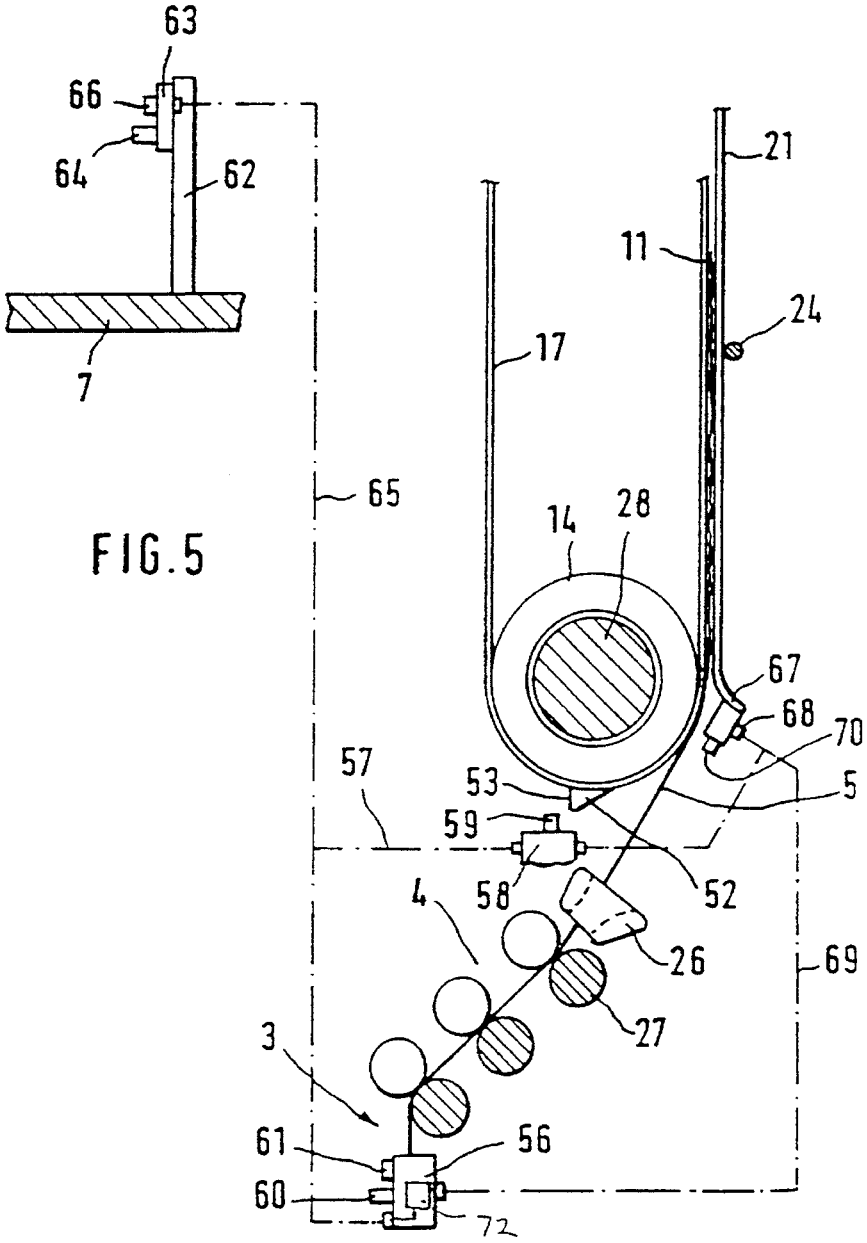
FIG. 5 is a partial sectional view similar to FIG. 2 showing another embodiment of the invention.

Deviating from the construction according to FIGS. 2 and 3, FIG. 5 is a schematic view of a variant, in the case of which the delivery roller 14 can be stopped automatically.

A yarn detector 56 is assigned to each spinning station 3, is arranged at a suitable point of the spinning station 3 and monitors the spun yarn. By way of an electric line 57, the yarn detector 56 is coupled with a control element 58 which may, for example, comprise a pneumatic cylinder out of which a piston 59 can be moved. After a yarn breakage is detected, the yarn detector 56 causes the piston 59 to move out of its cylinder by a certain amount.

The control element 58 is arranged such that the piston 59 does not hinder the cam 52 of the delivery roller 14 during the normal spinning operation. After a yarn breakage, when therefore the cam 59 has moved a certain amount out of its cylinder, it arrives in an area where it serves as a stop for the surface 53 of the cam 52. As a result, the delivery roller 14 is stopped although the driving shaft 28 and therefore the delivery rollers of the other spinning stations continue to rotate.

By way of a pushing device 60, the yarn detector 56 can also be operated manually so that the delivery roller 14 can be uncoupled from its shaft 28 at any time. When the piston 59 is to be pulled back again from the surface 53, the delivery roller 14 can again be coupled to the shaft 28 by the pressing of a push button 61 of the yarn detector 56.

So that the personnel situated on the platform 7, as necessary, can uncouple a delivery roller 14 from the shaft 28 independently of the yarn detector 56, another switch 63 is provided on a holding device 62 above the platform 7. By the operating of a push button 64, which is connected with the control element 58 by way of an electric line 65, the delivery roller 14 can therefore also be uncoupled from the shaft 28. By way of another push button 66, the delivery roller 14 can then again be coupled to the shaft 28.

On the end 67 of the skid 21, a sensor 68 is provided which, particularly after a batch change, is important for a first-time transporting of a sliver 5 to a spinning station 3. This is because the transport device 10 transport the slivers 5 at relatively slow speeds over a relatively long distance so that it may take between 5 and 10 minutes until the leading ends reach the respective drafting apparatus. It is impractical for an operator to wait for this period of time at each spinning position for checking the arrival of the leading end on the sliver at the drafting apparatus. The sensor 68 serves to control this operation by causing the feeding of the sliver 5 to stop after the detection of the leading end of a sliver 5.

The sensor 68, which can be an optical sensor, is connected with the yarn detector 56 by way of an electric line 69 and reports to the yarn detector 56 when the end of a newly pulled in sliver 5 has arrived at the sensor 68. The switching is such that the yarn detector 56 will then stop the delivery roller 14 by way of the control element 58. If necessary, the operating personnel may then insert the new starting piece of a sliver 5 in the spinning station 3 and may then, by way of a switch 70, render the sensor 68 inoperative. The sensor 68 is therefore deactivated during the normal spinning operation, and activated only during the above-described readying operation. The activation and deactivation may be performed by the operator at each spinning position or at a control unit. The delivery roller 14 can then be caused to resume its operation by the actuating of the push button 61 of the yarn detector 56 or of the push button 66 of the switch 63.

In certain embodiments, the yarn detector 56 contains a delay element 72 such that the report by the sensor 68 to the yarn detector 56 does not cause an immediate stopping of the sliver 5. Instead, the delay element 72 delays the stopping of the sliver 5 by the yarn detector 56 by an amount of time such that a sufficient length of sliver 5 hangs down from the transport device 10. This provides a length of sliver that is needed for insertion into the drafting apparatus.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine comprising a plurality of spinning stations which each include:

a sliver feeder including a sliver feed delivery roller, a drafting unit having feeding rollers connected downstream of the delivery roller with respect to sliver supplied by the sliver feeder, and a delivery roller drive connection between a rotatably driven delivery roller drive shaft and the delivery roller, said drive connection being selectively switchable between a first condition rotatably driving the delivery roller and a second condition out of driving connection with the delivery roller, wherein said delivery roller drive shaft is spaced from and out of driving contact with said feeding rollers when said drive connection is in said first condition rotatably driving the delivery roller, and wherein respective delivery roller drive connections at respective ones of the spinning stations are operable independently of one another, whereby sliver supply at respective spinning stations can be interrupted without intervening in operation of respective associated drafting units and without intervening in sliver feeding and spinning operations at other ones of said spinning stations.

2. A spinning machine according to claim 1, wherein the delivery rollers are each assigned to one transport belt respectively which transports at least one sliver.

3. A spinning machine according to claim 1, wherein the delivery rollers are connected directly in front of a pertaining drafting unit.

4. A spinning machine according to claim 1, wherein control switches are provided for selectively switching the drive connection at a respective spinning station between the first and second condition from several operating sites.

5. A spinning machine according to claim 1, wherein a sliver sensor is provided for determining the presence of sliver at each of the delivery rollers.

6. A spinning machine according to claim 5, wherein respective ones of the sliver sensors are coupled to respective delay elements, said delay elements being connected to control apparatus for automatically switching the drive connection at a respective delivery roller to the second condition after a predetermined time following detection of a leading end of a sliver by the respective sliver sensor.

7. A spinning machine according to claim 5, wherein the sensors are located between respective delivery rollers and feeding rollers of the respective spinning stations.

8. A spinning machine according to claim 5, wherein the sensors are optical sensors.

9. A spinning machine according to claim 1, wherein a longitudinally extending delivery roller drive shaft is provided for driving delivery rollers at a plurality of said spinning stations, and wherein said drive connection includes a torque limiter interposed between a respective delivery roller and the delivery roller drive shaft.

10. A spinning machine according to claim 1, wherein said delivery roller drive shaft extends through centers of a plurality of the respective delivery rollers, said delivery rollers being annular roller members surrounding the roller drive shaft.

11. A spinning machine according to claim 10, wherein each of said drive connections includes a selectively engageable clutch mechanism at each delivery roller for selectively drivingly connecting and disconnecting respective delivery rollers with the delivery roller drive shaft.

12. A spinning machine according to claim 11, wherein the delivery rollers are each assigned to one transport belt respectively which transports at least one sliver.

13. A spinning machine according to claim 11, wherein the delivery rollers are connected directly in front of a pertaining drafting unit.

14. A spinning machine according to claim 11, wherein control switches are provided for selectively switching the drive connection at a respective spinning station between the first and second condition from several operating sites.

15. A spinning machine according to claim 14, wherein a sliver sensor is provided for determining the presence of sliver at each of the delivery rollers.

16. A spinning machine according to claim 14, comprising control apparatus for switching the drive connection at a delivery roller to the second condition when a yarn break occurs at the respective spinning station.

17. A spinning machine according to claim 10, wherein respective ones of said drive connections includes a cam assigned to respective ones of the delivery rollers which rotates along with them and to which a stop can be applied for the stopping f the respective delivery roller.

18. A spinning machine according to claim 1, wherein the peripheral speed of the delivery rollers is controlled to be a predetermined slower speed than the peripheral speed of the feeding rollers.

19. A spinning machine according to claim 1, wherein the peripheral speed of the delivery rollers is controlled to be about 1.5% slower than the peripheral speed of the associated feeding rollers.

* * * * *